US007063573B2

(12) United States Patent
Chen

(10) Patent No.: US 7,063,573 B2
(45) Date of Patent: Jun. 20, 2006

(54) POWER JACK WITH ANTI-MATING MEANS

(75) Inventor: Wei-Xing Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 2 days.

(21) Appl. No.: 10/923,546

(22) Filed: Aug. 20, 2004

(65) Prior Publication Data

US 2006/0040565 A1 Feb. 23, 2006

(30) Foreign Application Priority Data

Aug. 20, 2003 (CN) ..... 92215075 U

(51) Int. Cl.
*H01R 13/64* (2006.01)

(52) U.S. Cl. ..... 439/677; 439/188

(58) Field of Classification Search ..... 439/677, 439/188, 668; 200/51.1
See application file for complete search history.

(56) References Cited

U.S. PATENT DOCUMENTS

| | | | | |
|---|---|---|---|---|
| 5,108,311 | A * | 4/1992 | Nakazawa | 439/607 |
| 5,927,999 | A * | 7/1999 | Shimojyo | 439/63 |
| 6,382,999 | B1 | 5/2002 | Mou et al. | 439/188 |
| 6,409,530 | B1 | 6/2002 | Zhao et al. | 439/188 |
| 6,482,045 | B1 * | 11/2002 | Arai | 439/680 |
| 6,551,115 | B1 * | 4/2003 | Li et al. | 439/79 |

* cited by examiner

*Primary Examiner*—Michael C. Zarroli
(74) *Attorney, Agent, or Firm*—Wei Te Chung

(57) ABSTRACT

A power jack (1) includes a dielectric housing (10) and a central terminal (20) received in the dielectric housing. The dielectric housing includes a mating face (11), a cavity (130) in the mating face and an anti-mating portion (15) formed on an inner face of the cavity for preventing full insertion of a non-complementary power plug having a smaller transmission power than that of the power jack. The central terminal includes a contact section (21) extending into the cavity for electrically connecting with a complementary power plug.

11 Claims, 7 Drawing Sheets

POWER JACK WITH ANTI-MATING MEANS

BACKGROUND OF THE INVENTION

1. Field of the Invention

The present invention relates to a power jack, and particularly to a power jack having anti-mating means for preventing a power plug which transmits smaller power than the power jack from inserting thereinto.

2. Description of Related Art

A power supply system for an electrical equipment, such as a personal computer, commonly includes a power jack disposed inside the electrical equipment and a power cable assembly disposed outside the electrical equipment. The power cable assembly includes a power plug adapted for engaging with the power jack and a cable having one end electrically connecting with the power plug and another end for electrically connecting to a power supply.

The power jacks or plugs are commonly manufactured in compliance with a certain standard, which requires the dimension and the profile of the power jacks or plugs be similar to each other. Therefore, it constantly happens that a non-complementary power plug is unintentionally inserted into a power jack. As a result, the non-complementary power plug might be damaged due to overload if the transmission power of the power jack is larger than that of the non-complementary power plug.

Hence, a power jack with anti-mating means is desired to overcome the disadvantage of the prior art.

SUMMARY OF THE INVENTION

An object of the present invention is to provide a power jack with an anti-mating portion for blocking insertion of a power plug having a smaller transmission power than that of the power jack.

To achieve the above object, a power jack includes a dielectric housing and a central terminal received in the dielectric housing. The dielectric housing includes a mating face, a cavity in the mating face and an anti-mating portion formed on an inner face of the cavity for preventing full insertion of a non-complementary power plug having a smaller transmission power than that of the power jack. The central terminal includes a contact section extending into the cavity for electrically connecting with a complementary power plug.

Other objects, advantages and novel features of the invention will become more apparent from the following detailed description when taken in conjunction with the accompanying drawings.

DETAILED DESCRIPTION OF THE PREFERRED EMBODIMENT

Figure 3:
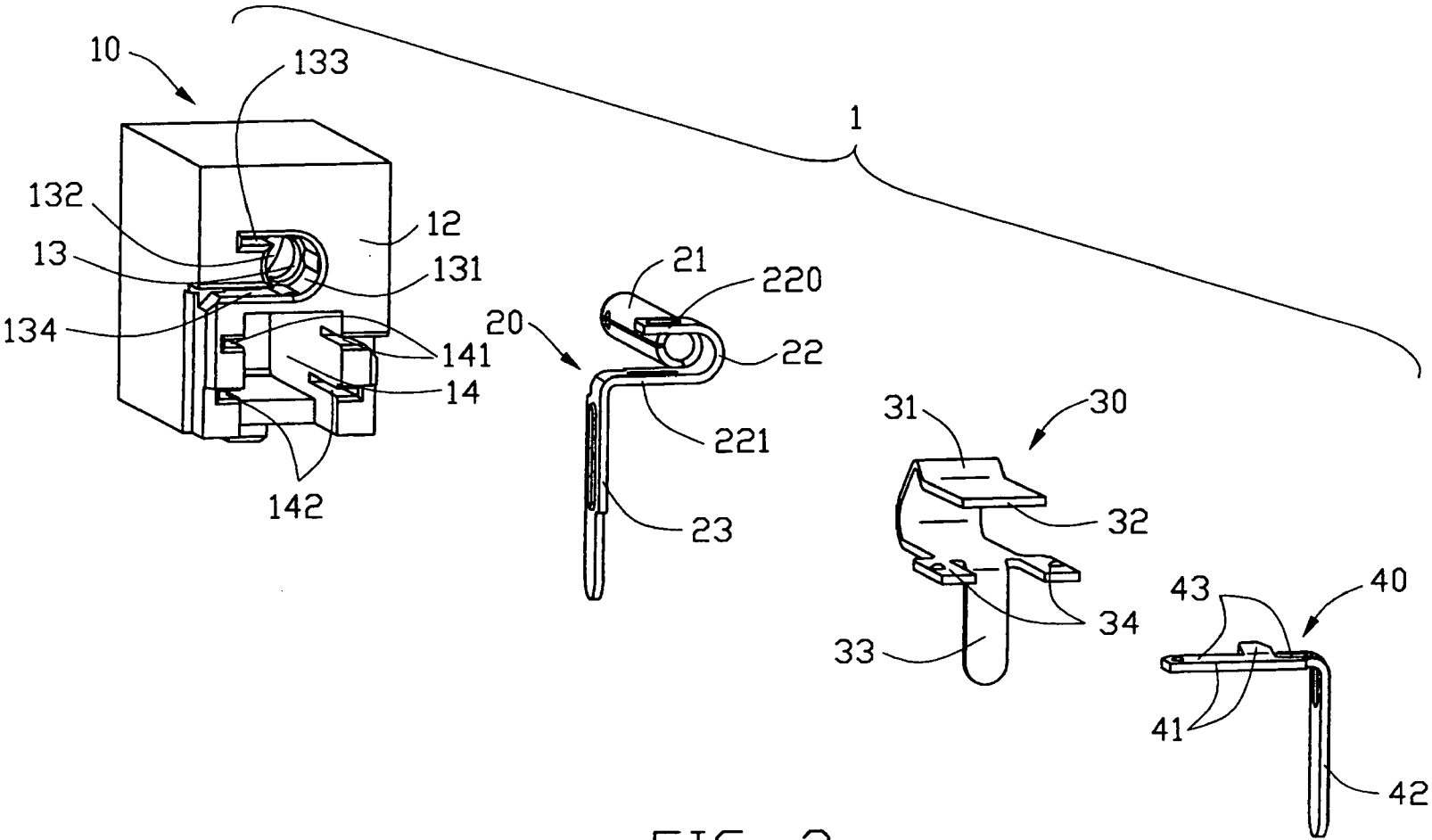
FIG. 3 is an exploded perspective view of the power jack shown in FIG. 1.

As shown in FIG. 3, a power jack 1 in accordance with the present invention comprises a dielectric housing 10, a central terminal 20 accommodated in the dielectric housing 10, a spring terminal 30 located beside the central terminal 20, and a switch terminal 40.

Figure 1:
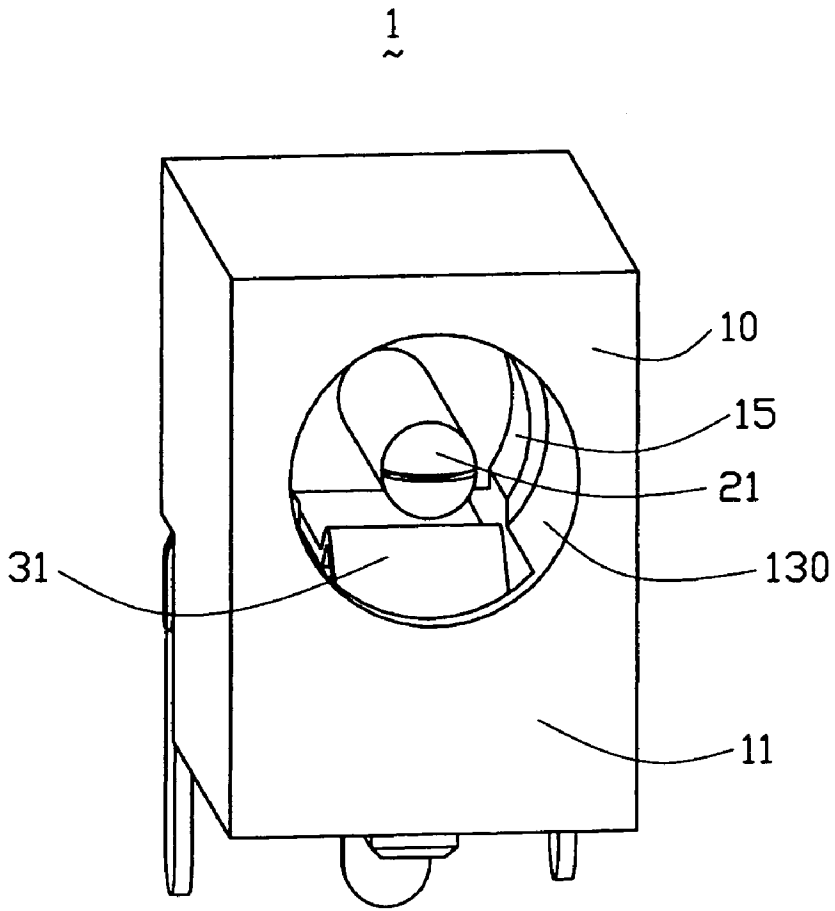
FIG. 1 is a front perspective view of a power jack in accordance with the present invention.
Figure 2:
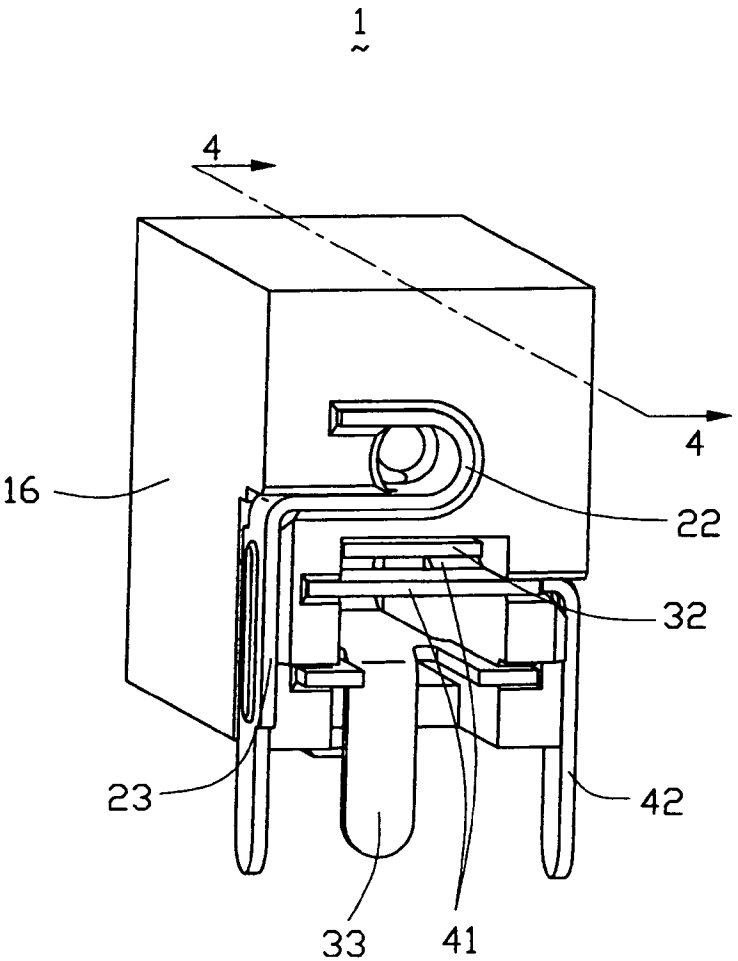
FIG. 2 is a rear perspective view of the power jack shown in FIG. 1.
Figure 4:
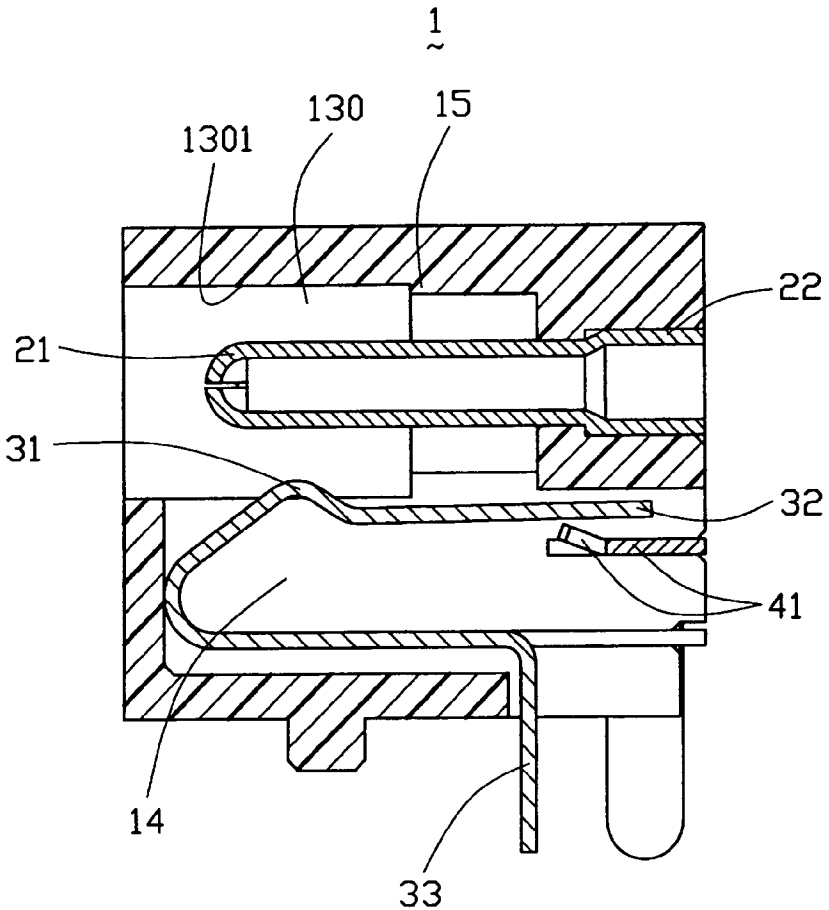
FIG. 4 is a cross-sectional view of the power jack taken along line 4—4 of FIG. 2.

Referring to FIGS. 1, 3 and 4, the dielectric housing 10 comprises a front mating face 11, a rear face 12 opposite to the front mating face 11, a cylindrical receiving space 13 passing through the mating face 11 and the rear face 12. The receiving space 13 comprises a cavity 130 extending from the mating face 11 and having a largest diameter, a recess 131 extending from the rear face 12 and having an interim diameter and a channel 132 located between the cavity 130 and the recess 131 and having a smallest diameter. The dielectric housing 10 comprises a pair of side faces 16 perpendicular to and interconnecting with the mating face 11 and the rear face 12, an upper slot 133 being tangent with the recess 131 at an upper edge of the recess 131 and extending toward one of the side faces 16, and a lower slot 134 being tangent with the recess 131 at a lower edge end of the recess 131 and extending to the same side face 16. The central terminal 20 comprises a contact section 21 configured in a hollow column, a retaining section 22 extending from the contact section 21 and a soldering section 23 extending downwardly from the retaining section 22 for electrically connecting with a printed circuit board (PCB, not shown). The retaining section 22 has an upper and a lower legs 220, 221. The contact section 21 is received in the channel 132 with a free end thereof extending into the cavity 130. The retaining section 22 is received in the recess 131 with the upper and the lower legs 220, 221 respectively retained in the upper and the lower slots 133, 134.

The dielectric housing 10 comprises a rectangular chamber 14 defined in the rear face 12 and located below and communicating with the receiving space 13, and two pairs of upper and lower cutouts 141, 142 extending through the rear face 12 and opposite inner side faces of the chamber 14. The spring terminal 30 is received in the chamber 14 and comprises a curved section 31 extending into the cavity 130, a contact section 32 integrally extending rearwardly from the curved section 31, a pair of arms 34 respectively retained in the lower cutouts 142 and a soldering section 33 for electrically connecting with a detected circuit disposed in the PCB. The switch terminal 40 is configured in an approximate L-like shape and comprises a pair of retaining section 43 respectively retained in the upper cutouts 141, a contact section 41 located between the retaining portions 43 and a soldering section 42 extending perpendicularly from one retaining section 43 for electrically connecting with the detecting circuit in the PCB. The switch terminal 40 is received in the chamber 14 with the contact section 41 spaced from and located below the contact section 32 of the spring terminal 30.

Figure 5:
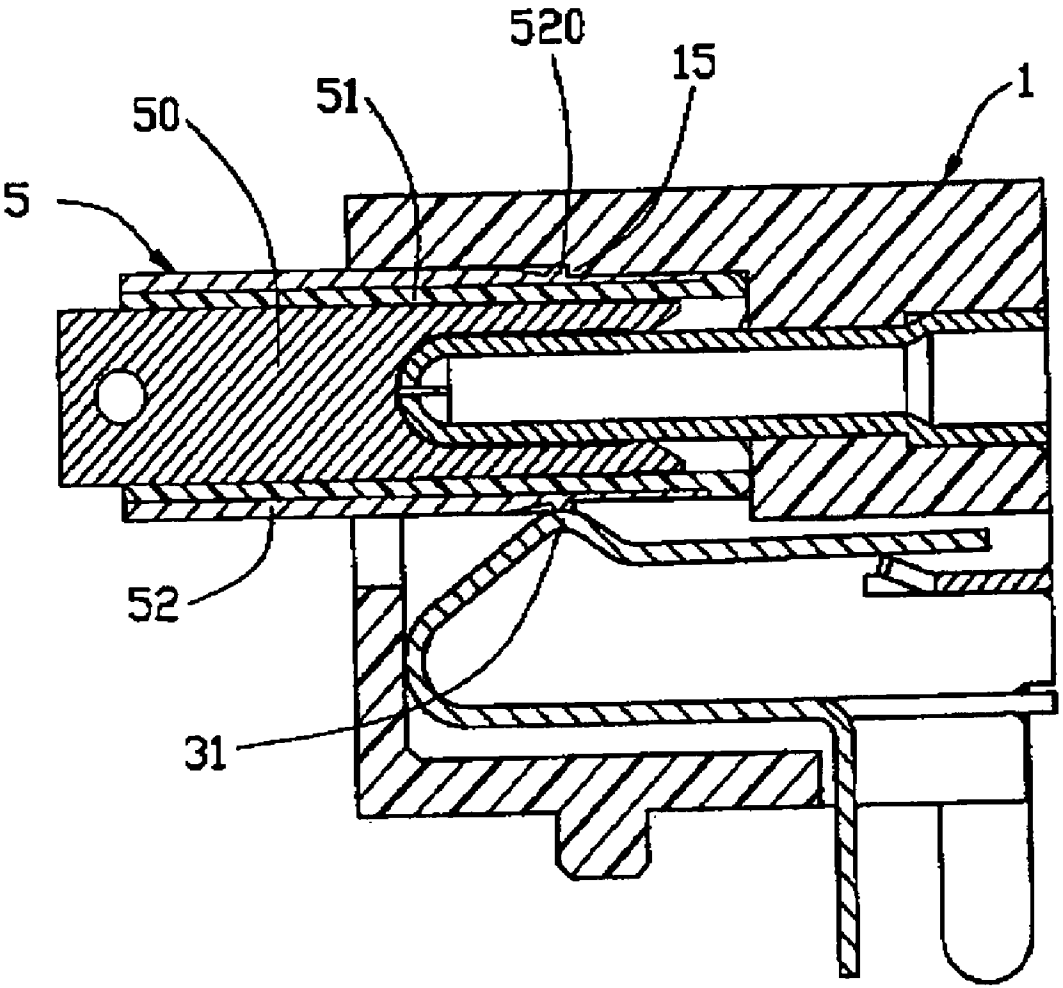
FIG. 5 is a cross-sectional view of the power jack mating with a complementary power plug.

As best shown in FIG. 5, a complementary power plug 5 comprises a mating face (not labeled), a forked first terminal 50 for electrically and mechanically connecting with the central terminal 20 of the power jack 1, a cylindrical second terminal 52 surrounding the first terminal 50 and a dielectric housing 51 located between the first and the second terminals 50, 52. After the complementary power plug 5 is completely inserted into the cavity 130 of the power jack 1, the second terminal 52 of the power plug 5 downwardly presses against the curved section 31 of the spring terminal 30 to actuate the contact section 32 of the spring terminal 30 to move downwardly along with the curved section 31 and until the contact section 32 electrically and mechanically contacts with the contact section 41 of the switch terminal 40. Thus, the detected circuit in the PCB electrically connecting with the spring terminal 30 and the switch terminal 40 can detect whether the power jack 1 properly engages with the power plug 5.

As best shown in FIG. 4, the dielectric housing 10 is formed with a first anti-mating portion 15 extending into the cavity 130, such as a projection integrally and radially extending from an annular inner face 1301 of the cavity 130 for preventing a non-complementary power plug from inserting into the power jack 1. Referring to FIG. 5, the second terminal 52 is formed with a second anti-mating portion 520, such as a protrusion integrally and radially projecting therefrom. The complementary power plug 5 completely engages with the power jack 1 of the present invention with the first anti-mating portion 15 of the power jack 1 abutting against the second anti-mating portion 520 of the power plug 5.

Figure 6:
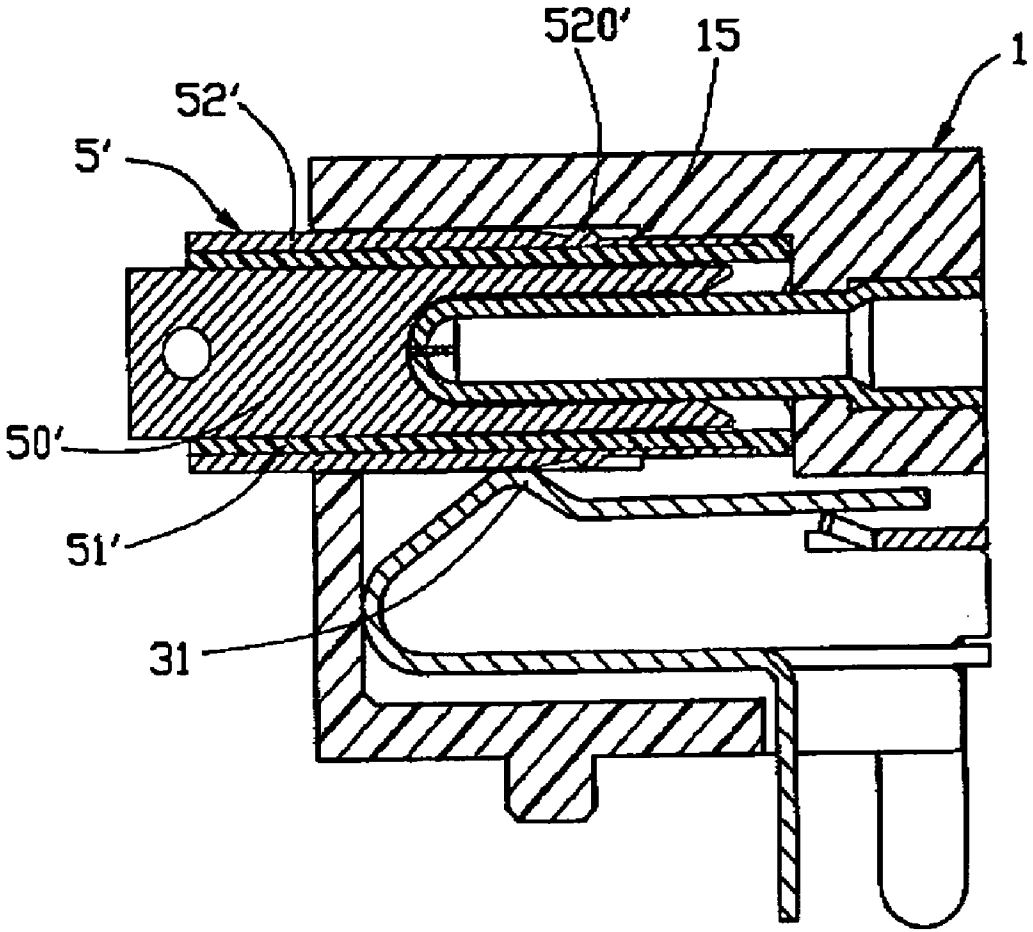
FIG. 6 is a cross-sectional view of the power jack mating with a power plug transmitting larger power than the power jack.
Figure 7:
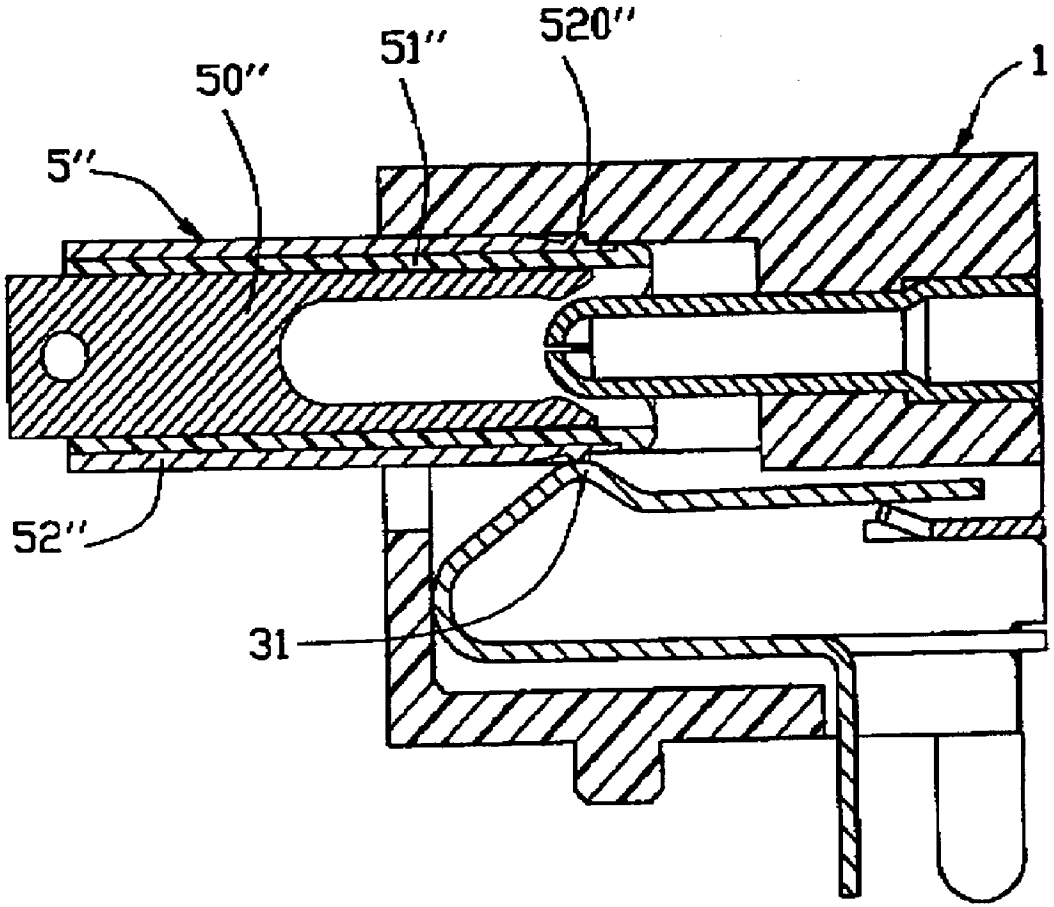
FIG. 7 is a cross-sectional view of the power jack blocking the insertion of a power plug, which transmitting smaller power than the power jack.

As best shown in FIGS. 6 and 7, the non-complementary power plugs are divided into a power plug 5' transmitting larger power than the power jack 1 and a power plug 5" transmitting smaller power than the power jack 1. The non-complementary power plugs 5', 5" are almost the same as the complementary power plug 5 in structure except for a distance between a second anti-mating portion and a mating face thereof. The distance between a second anti-mating portion 520' and a mating face of the power plug 5" is larger than that of the complementary power plug 5. The distance between a second anti-mating portion 520" and a mating face of the power plug 5" is smaller than that of the complementary power plug 5. Therefore, the first anti-mating portion 15 of the power jack 1 cooperates with the second anti-mating portion 520" of the power plug 5" to block insertion of the power plug 5" and the first terminal 50" does not electrically connect with the contact section 21 of the central terminal 20 of the jack, thereby protecting the power plug 5" having a small transmission power from damage. The power plug 5' can completely engage and electrically connect with the power jack 1 with the second anti-mating portion 520' thereof spaced from the first the anti-mating portion 15 of the power jack 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power jack comprising:

a dielectric housing comprising a mating face, a cavity in the mating face and an anti-mating portion formed on an inner face of the cavity for preventing the power jack from being fullly inserted and electrically connecting with a power plug having a smaller transmission power than that of the power jack, but allowing the power jack being inserted and electrically connecting with a power plug having a same or larger transmission power than that of the power jack; and a central terminal comprising a contact section extending into the cavity and a soldering section for electrically connecting with a printed circuit board.

2. The power jack as claimed in claim 1, wherein the cavity is a circular shape, and wherein the anti-mating portion is a projection integrally and radially extending from the inner face of the cavity.

3. The power jack as claimed in claim 1, wherein the dielectric housing comprises a rear face opposite to the mating face and a chamber defined in the rear face located below and communicating with the cavity.

4. The power jack as claimed in claim 3, further comprising a spring terminal received in the chamber and having a curved section extending into the cavity and a contact section movable along with the curved section.

5. The power jack as claimed in claim 4, further comprising a switch terminal retained in the housing and having a contact section electrically connecting with the contact section of the spring terminal when the curved section of the spring terminal is pressed.

6. A connector assembly comprising:

a power jack comprising a dielectric housing, a central terminal and a spring terminal both received in the dielectric housing, the dielectric housing comprising a mating face, a cavity in the mating face and a first anti-mating portion extending into the cavity, the central terminal comprising a contact section extending into the cavity; and a power plug comprising a first terminal for engaging with the contact section of the central terminal, a second terminal surrounding the first terminal for engaging with the spring terminal and formed with a second anti-mating portion and a dielectric housing between the first and the second terminals, the first anti-mating portion of the power jack engaging with the second anti-mating portion of the power plug for preventing the power plug from further insertion into the cavity.

7. The connector assembly as claimed in claim 6, wherein the first anti-mating portion of the power jack is a projection integrally and radially extending from an annular inner face of the cavity.

8. The connector assembly as claimed in claim 6, wherein the second anti-mating portion of the power plug is a protrusion integrally and radially extending from the second terminal.

9. The connector assembly as claimed in claim 6, where said first anti-mating portion and said second anti-mating portion are engaged with each other along a mating direction between said power plug and said power jack.

10. A method of determining a proper plug, the method comprising:

providing a jack comprising a dielectric housing with at least one central terminal, the dielectric housing comprising a mating face, a cavity extending inward from the mating face, a first anti-mismating device formed in the cavity; and providing a plug pool including randomly at least one correct plug and one incorrect plug, each of said plugs defining a central contact hidden behind a front face thereof and enclosed by a circumferential piece, a second anti-mating device formed on the circumferential, and a distance between the front face and the second anti-mating device in the incorrect plug is smaller than that between the front face and the second anti-mismating device in the correct plug;

respectively mating each one of the plugs with the jack, the central contact radially engaged with the central terminal, and the first anti-mating device confronting the second anti-mating device in a mating direction to prevent the incorrect plug from electrically connecting with the jack via abutment between the first anti-mating device and the second anti-mismating device in the mating direction while allowing the correct plug to electrically connect with the jack.

11. The method of determining a proper plug as claimed in claim 10, wherein said circumferential piece is another contact which is engaged with another terminal when the plug and the jack are mated together.

* * * * *